US005664428A

United States Patent [19]

Sugiyama et al.

[11] Patent Number: 5,664,428

[45] Date of Patent: Sep. 9, 1997

[54] INDOOR UNIT FOR AN AIR-CONDITIONING APPARATUS

[75] Inventors: Akihiko Sugiyama; Katsushi Ishii, both of Fuji; Hidenori Ashikawa, Yokohama; Michika Uesugi; Haruo Ishikawa, both of Fuji; Hitoshi Wakatsuki, Numazu; Kimithuka Ueda, Fuji, all of Japan

[73] Assignee: Kabushiki Kaisha Toshiba, Kawasaki, Japan

[21] Appl. No.: 536,775

[22] Filed: Sep. 29, 1995

[30] Foreign Application Priority Data

Mar. 7, 1995 [JP] Japan ..... 7-047296
Mar. 31, 1995 [JP] Japan ..... 7-074880

[51] Int. Cl.[6] ..... F25D 23/12

[52] U.S. Cl. ..... 62/259.1; 62/262

[58] Field of Search ..... 62/262, 263, 259.1

[56] References Cited

U.S. PATENT DOCUMENTS

| | | | |
|---|---|---|---|
| 2,654,227 | 10/1953 | Muffly | 62/262 |
| 3,301,003 | 1/1967 | Laing | 62/263 |
| 4,800,734 | 1/1989 | Sauber et al. | 62/263 |
| 4,958,504 | 9/1990 | Ichikawa et al. | 62/259.1 |
| 5,038,577 | 8/1991 | Stanford | 62/262 |
| 5,065,596 | 11/1991 | Harris et al. | 62/262 |
| 5,361,981 | 11/1994 | Albert et al. | 62/263 |
| 5,372,189 | 12/1994 | Tsunekawa et al. | 62/263 |
| 5,388,426 | 2/1995 | Wada et al. | 62/263 |

FOREIGN PATENT DOCUMENTS

| | | |
|---|---|---|
| 1 524 702 | 9/1978 | United Kingdom . |
| 2 120 380 | 11/1983 | United Kingdom . |
| 2 172 094 | 9/1986 | United Kingdom . |
| 2 217 826 | 11/1989 | United Kingdom . |

*Primary Examiner*—William E. Tapolcai
*Attorney, Agent, or Firm*—Cushman Darby & Cushman IP Group of Pillsbury Madison & Sutro, LLP

[57] ABSTRACT

An air conditioner having an indoor unit and an outdoor unit which are connected by a refrigerant pipe and electric cables. The indoor unit has a housing, in which a heat exchanger, a fan device and a compressor are arranged. A partition divides the interior of the housing into a fan chamber and a compressor chamber. The fan chamber contains the fan and opens at the front of the housing. The compressor chamber contains the compressor and opens at the back of the housing. Not incorporating the compressor, the outdoor unit is smaller and lighter than otherwise. The indoor unit is secured to the wall of a room, with the back of the housing facing the wall. Hence, the noise the compressor makes while operating does not annoy the persons in the room is much.

11 Claims, 8 Drawing Sheets

INDOOR UNIT FOR AN AIR-CONDITIONING APPARATUS

BACKGROUND OF THE INVENTION

1. Field of the Invention

This invention relates to an air-conditioning apparatus comprising an indoor unit and an outdoor unit, and more particularly to an indoor unit for an air-conditioning apparatus.

2. Description of Related Art

Generally an air conditioner which has an refrigerating cycle and which can cool and heat a room comprises an indoor unit and an outdoor unit.

The indoor unit is provided on the wall of the room and incorporates an indoor heat exchanger and an indoor fan. The outdoor unit is located outside the house and contains a compressor, an outdoor heat exchanger, an outdoor fan, an expansion valve and the like which constitute the refrigerating cycle.

The compressor is provided in the outdoor unit so that the persons in the room may not be bothered with the noise the compressor makes while operating. Containing the compressor, the outdoor unit is large had heavy. In some cases, the space between the house and the neighboring houses is too small to accommodate the outdoor unit. To make the outdoor unit small enough to be placed in that limited space, the compressor which is a large and heavy component may be provided in the indoor Unit, not in the outdoor unit. An indoor unit which incorporates the compressor, together with the indoor heat exchanger and the indoor fan, is known as "floor-based indoor unit." As the name implies, this type of an indoor unit is arranged on the floor of the room.

An outdoor unit used in combination with a floor-based indoor unit is small and light since it contains no compressor. Since, the outdoor unit is not heavy it can be easily hung on the outer wall of the house, with a small and simple support.

In the floor-based indoor unit, the compressor is located at the lowest position, the heat exchanger and the fan are arranged above the compressor, and an air chamber is provided at the top. In the chamber the air which has undergone heat exchange is accumulated and pressure-regulated. The pressure-regulated air is discharged from the cheer through the outlet port made in the top wall of the indoor unit.

An air conditioner comprising a floor-based indoor unit and a small and light outdoor unit has a drawback. The noise the compressor makes while operating is liable to leak from the indoor unit. While the compressor is operating, its vibration propagates to the floor, which vibrates, making a noise. The people in the room not only hear the noise but also feels the vibration. The noise appears to them larger than it really is, because of the vibrating floor.

The floor-based indoor unit may be replaced by an indoor unit of the ordinary type which is secured to the wall, and a compressor may be incorporated into the ordinary type indoor unit. In this case, the vibration of the compressor propagate via the wall to the ceiling, not to the floor. The ordinary type indoor unit has a front plate having an air inlet port and a back plate provided at the rear of the fan. The back plate has its lower portion bent toward the lower edge of the front plate, serving a part of a fan casing. An air outlet port is defined between the lower portion of the back plate and the lower edge of the front plate. In order to accommodate a compressor in the ordinary type indoor unit, a partition must be provided to define a compressor chamber, jointly with the back plate. A gap is likely to be formed between the back plate and the partition. The larger this gap, the larger the housing of the indoor unit, and the larger the amount of heat and noise leaks from the compressor to the indoor fan. This will decrease the cooling efficiency and increase the noise.

To minimize the gap between the back plate and the partition, the partition may be connected to the fan casing. In this case, the partition must be connected to the fan casing to have its vertical portion positioned flush with the back plate; the indoor fan could not otherwise apply air to the heat exchanger with high efficiency. However, it is difficult to connect the partition to the fan casing in that manner within a relatively short time.

Jpn. Pat. Appln. KOKAI Publication No. 63-42264 discloses an air conditioner, in which the indoor unit is partitioned into a compressor chamber and a heat exchanger chamber. The compressor chamber contains the compressor, and the heat exchanger chamber contains the heat exchanger and the fan. The lower half of the compressor chamber is closed by a sound barrier plate. The upper half of the compressor chamber can be closed and opened by the front panel which has an opening communicating with the heat exchanger chamber. The noise the compressor makes while operating is likely to leak from the compressor chamber into the room through the opening of the front panel, inevitably annoying the persons in the room.

SUMMARY OF THE INVENTION

In view of the forgoing, the object of the present invention is to provide an air-conditioning apparatus which can be assembled with high efficiency and in which the compressor is incorporated in the indoor unit to reduce the size and weight of the outdoor unit, the noise the compressor is prevented from leaking from the indoor unit, and the indoor fan can apply air with high efficiency.

According to the present invention, there is provided an indoor unit for an air conditioner, which comprises: a main body having a front and a back; a heat exchanger provided in the main body; a fan device provided in the main body; a compressor provided in the main body; and partition means provided in the main body, defining a fan chamber opening opens at the front of the main body and containing the fan, and a compressor chamber opening at the back of the main body and containing the compressor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred embodiments given below, serve to explain the principles of the invention.

DETAILED DESCRIPTION OF THE PREFERRED EMBODIMENTS

Air conditioners which are the embodiments of the invention will be described, with reference to the accompanying drawings.

Figure 1:
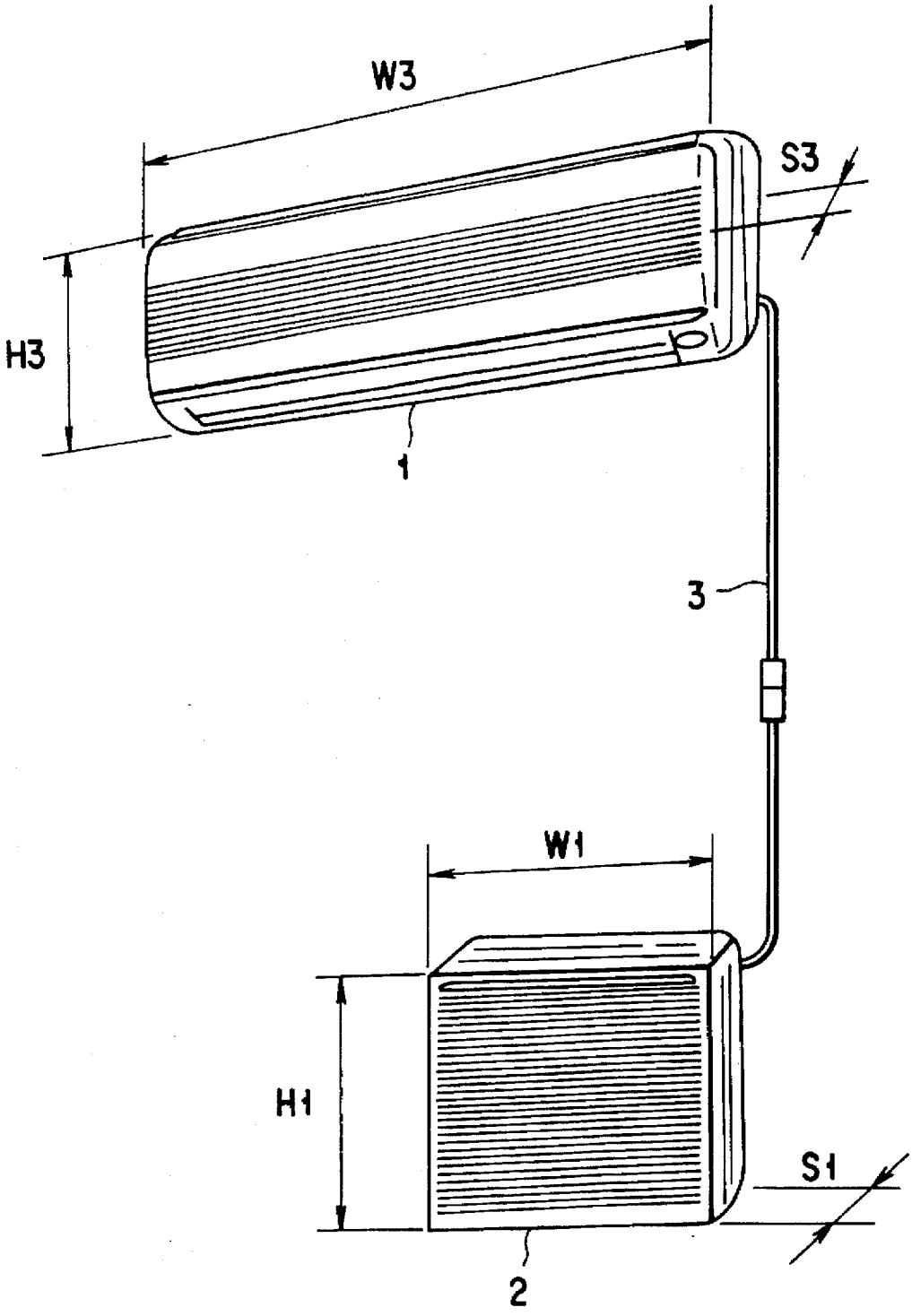
FIG. 1 is a perspective view of an air conditioner according to a first embodiment of the invention, indicating the dimensions of the indoor and outdoor units of the air conditioner.

The air conditioner according to the first embodiment will be described with reference to FIGS. 1 to 4. As shown in FIG. 1, the air conditioner comprises an indoor unit 1 and an outdoor unit 2. The indoor unit 1 is secured by suitable means to an upper part of the wall (not shown) of a room. The outdoor unit 2 is provided outside the house (not shown) and placed on the ground.

The indoor unit 1 and the outdoor unit 2 are connected to each other by a connector 3 which consists of coolant pipes and electric cables. The indoor unit 1 incorporates a compressor as will be described later in detail. The outside unit therefore need not have a power-supply control circuit or a control signal line which is associated with the compressor. It incorporates an outside heat exchanger, an outdoor fan and an expansion valve, which constitute a refrigerating cycle.

Figure 2:
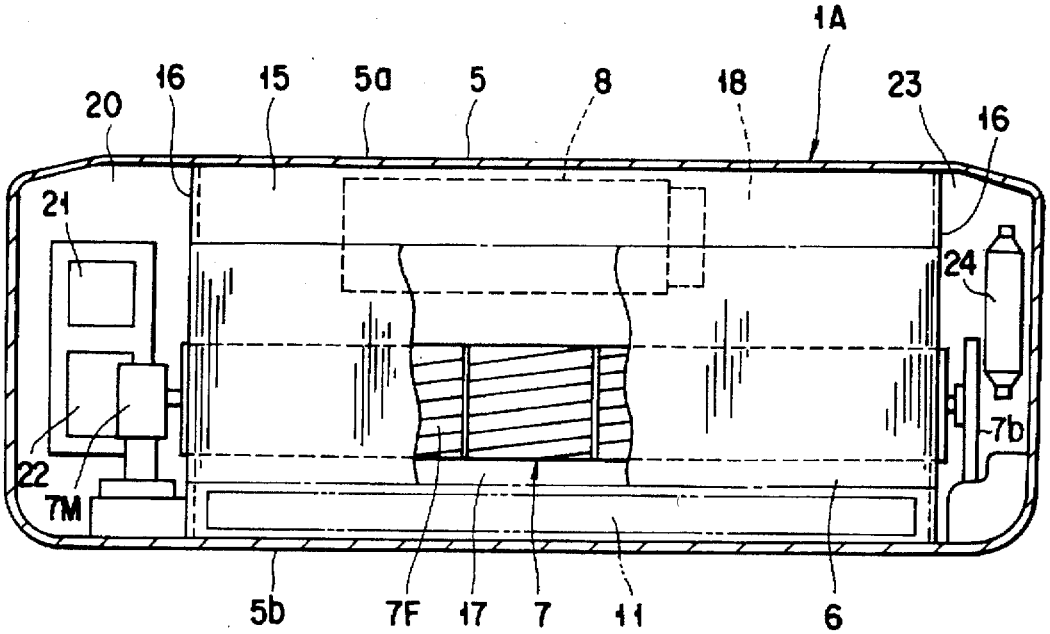
FIG. 2 is a sectional front view of the indoor unit of the air conditioner shown in FIG. 1.
Figure 3:
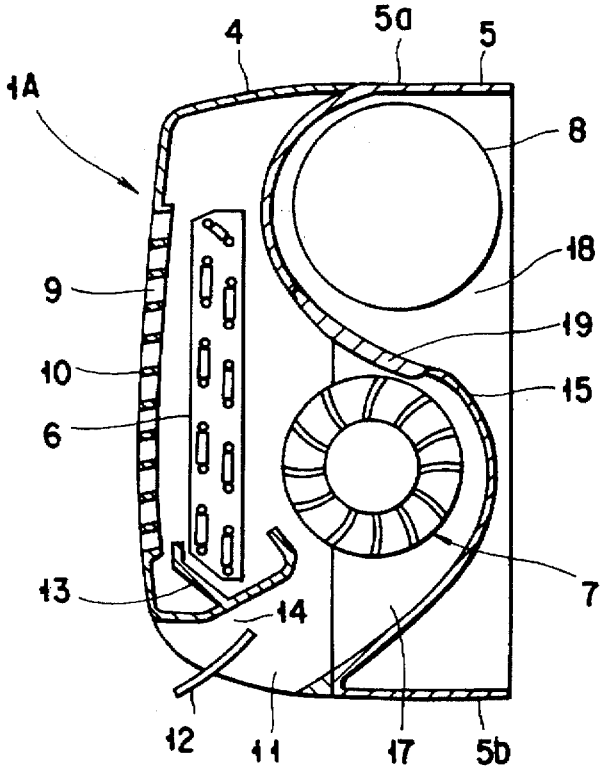
FIG. 3 is a sectional side view of the indoor unit of the air conditioner shown in FIG. 1.
Figure 4:
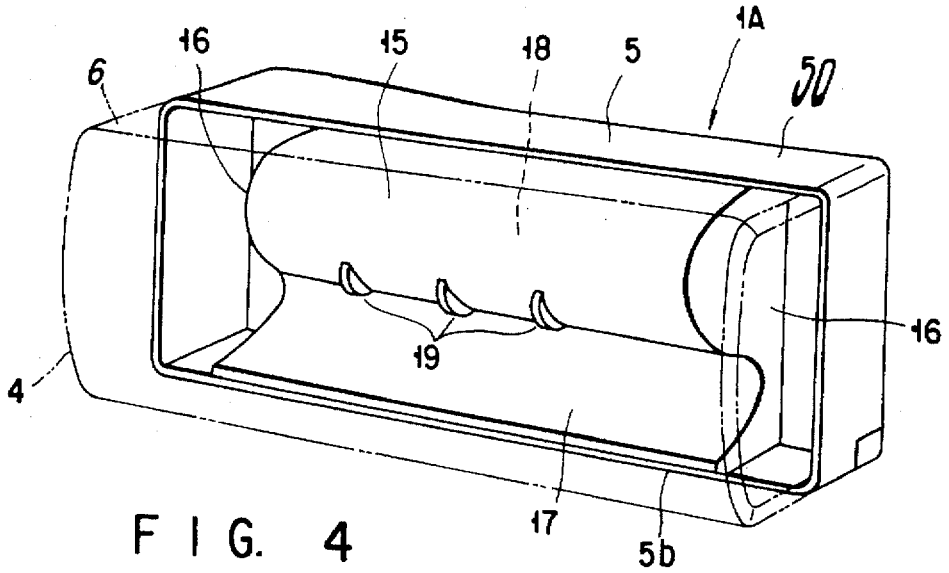
FIG. 4 is a perspective view showing the back plate of the indoor unit.

As illustrated in FIGS. 2, 3 and 4, the housing 1A of the indoor unit 1 contains an indoor heat exchanger 6, an indoor fan device 7 and a compressor 8. The housing 1A comprises a front panel 4 and a rear casing 5. The front panel 4 has an air inlet port 9, in which grill 10 is fitted. The front panel 4 has an air outlet port 11, which is located below the grill 10. A louver 12 is provided in the air outlet port 11 to change the direction in which to apply air from the indoor unit 1.

In the housing 1A, the indoor heat exchanger 6 is arranged, opposing the grill 10. The heat exchanger 6 has a front as large as the grill 10. It has a number of fins and a heat-exchanging pipe. The fins are juxtaposed at short regular intervals. The heat-exchanging pipe meanders, passing through the fins.

In the housing 1A, a drain tray 13 is arranged below the indoor heat exchanger 6. The tray 13 forms a part of the air outlet port 11 and functions as the nose of a air outlet path 14 which extends from the indoor fan device 7 to the air outlet port 11.

The rear casing 5 of the housing 1A comprises a rectangular frame and a partition 15. The frame consists of an upper plate 5*a*, a lower plate 5*b*, a left side wall 16 and a right side wall 16. The partition 15 stretches between the upper and lower plates and formed integral therewith. The partition 15 is curved in the form of letter S as seen from the side, as is illustrated in FIG. 3. As is shown in FIG. 4, the partition 15, the side walls 16, the upper plate 5*a* and the lower plate 5*b* define a fan chamber 17 and a compressor chamber 18. The fan chamber 17 opens at the front of the housing 1A, and the compressor chamber 18 opens at the back of the housing 1A.

The fan chamber 17 is a fan casing which serves as the lower part of the air outlet path 14. It communicates at front end to the air outlet port 11. As shown in FIG. 2, the indoor fan device 7 comprises a fan motor 7M and a cross-flow fan 7F. The cross-flow fan 7F is connected to the shaft of the fan motor 7M and is provided in the fan chamber 17. The fan motor 7M is located outside the fan chamber 17, on one side thereof. Provided on the other side of the fan chamber 17 is a bearing 7*b*, which supports the free end portion of the cross-flow fan 7F.

The cross-flow fan 7F is positioned at the back of the indoor heat exchanger 6. It is as long as the heat exchanger 6 is wide and opposes the heat exchanger 6. Hence, the width of the fan chamber 17 (i.e. the width of the partition 15) is equal to the length of the fan 7F and the width of the heat exchanger 6.

The compressor 8 is provided in the compressor chamber 18. The compressor 8 is a helical compressor, which is fastened at both sides to the upper edge of the partition 15 by a fastener (not shown). The compressor chamber 18 opens at the back of the housing 1A as described above, and is closed at the front and both sides by the partition 15 and the side walls 16.

As seen from FIGS. 3 and 4 only, a plurality of ribs 19 are formed on and integral with that part of the partition 15 which lies between the cross-flow fan 7F and the helical compressor 8. The ribs 19 exist in the fan chamber 17 and reinforce the partition 15. Reinforced by the ribs 19, the partition 15 is rigid enough to hold the compressor 8 in place though the compressor is large and heavy. Further, since the partition 15 has an S-shaped section, it is hard.

Existing in the fan chamber 17 and extending at right angles to the axis of the cross-flow fan 7F, the ribs 19 regulate the flow of air applied by the cross-flow fan 7F. In other words, the fins 19 function as flow-regulating fins.

At one side of the partition 15 (the left side in FIG. 2), an electric component chamber 20 is defined by the rear casing 5 and one side wall 16. A driving circuit 21, a control circuit 22 and some other electric components are provided in the electric component chamber 20. The driving circuit 21 is designed to drive the fan motor 7M and the compressor 8.

The control circuit 22 is designed to control the driving circuit 22 in optimal conditions in accordance with control signals supplied from a remote-control device (not shown) and a sensor (not shown) detecting the temperature of the heat exchanger 6. The drive circuit 21 is electrically connected to the control circuit 22 by a cord. The fan motor 7M and the compressor 8 are electrically connected to the driving circuit 22 by a cord.

The rear casing 5 (including the partition 15) and the side walls 16 define a refrigerating cycle chamber 23 at the other side of the partition 15 (the right side in FIG. 2). In the chamber 23 there are provided refrigerating cycle components 24 including a four-way valve. The components 24 constitute a refrigerating cycle, jointly with the indoor heat exchanger 6, the compressor 8 and the outdoor heat exchanger provided in the outdoor unit 2.

When the indoor unit 1 is operated, the compressor 8 generates heat and makes noise. Neither the heat nor the noise leaks from the indoor unit 1 into the room. This is because the compressor 8 is sealed within the compressor chamber 18 which is defined by the partition 15 and the side walls 16 and which opens only at the back of the housing 1A, and the rear casing 5 has no gaps. It should be recalled that the side walls 16 are formed integral with the rear casing 5 including the partition 15 and that the partition 15 stretches between the upper and lower plates of the casing 5 and formed integral therewith. Since the heat does not leak into the room, the air conditioner is not over-loaded while operating in cooling mode. Since the noise does not leak into the room, the people in the room are not annoyed.

The fan chamber 17 can be provided without connecting parts with high precision, since it is defined by the partition 15 and both side walls 16 it functions also as a fan casing as indicated above. Furthermore, the fan chamber 17 increases the efficiency of applying air to the indoor heat exchanger 6 since, as described above, it serves as the lower part of the air outlet path 14 and communicates at a lower end to the air outlet port 11.

Still further, the partition 15 which is an integral part of the rear casing 5 suffices to separate the fan chamber 17 and the compressor chamber 18. No other member is required to separate the chambers 17 and 18 from each other. This facilitate the assembling of the indoor unit 1.

The ribs 19 provided on the partition 15 render the partition 15 rigid enough to hold the compressor 8 steadily, despite that the compressor is large and heavy. In addition, the ribs 19 regulate the flow of air applied by the cross-flow fan 7F since they are located in the fan chamber 17 and extend at right angles to the axis of the cross-flow fan 7F.

As seen from FIG. 2, the compressor 8 is located 10 in the middle part of the housing 1A. Due to this specific position of the compressor 8, the indoor unit 1 is balanced well and is easy to position on the wall and to fasten thereto.

Dew may form on the components 24 provided in the chamber 23 as the air conditioner operates in a cooling mode. Dews, if any, cannot flow into the electric component chamber 20 to short-circuit the electric components provided in the chamber 20, such as the driving circuit 21 and the control circuit 22. This is because, as shown in FIG. 2, the electric component chamber 20 and the refrigerating cycle chamber 23 are sealed by the side walls 16, located at the ends of the partition wall 15 and spaced apart from each other for a long distance. The electric components 24 therefore remain reliable.

As can be understood from FIGS. 2 and 3, the compressor 8 is positioned horizontally and in parallel to the cross-flow fan 7F, with the partition 15 interposed between it and the fan 7F and with its axis extending in the horizontal direction. The compressor 8 can therefore be located within the space provided above the cross-flow fan 7F, which is the upper dead space in the housing 1A. The housing 1A need not be made higher to accommodate the compressor 8. The indoor unit 1 has its center of gravity at a low position and is therefore balanced well.

Moreover, since the axes of the compressor 8 and the cross-flow fan 7F are parallel, the housing 1A is vibrated less while the the compressor 8 is operating, than in the case where the axes of the compressor 8 and the fan 7F incline to each other.

Since the driving circuit 21 for controlling the compressor 8 is provided in the electric component chamber 20 as indicated above, the circuit 21 is located very near the compressor 8. The electric connection system connecting the compressor 8 to the circuit 21 is therefore more simple than in the case where the circuit 21 is remote from the compressor 8. It is easier to design the electric control system and lay the wiring associated with the control system than in the conventional air conditioner, in which the outdoor unit incorporates the compressor.

By incorporating the compressor 8, the outdoor unit 2 is smaller and lighter and occupies less installation space and requires less rigid support, than the outdoor unit of the conventional air conditioner. This will be apparent from the following explanation made with reference to FIGS. 1 and 14.

Figure 14:
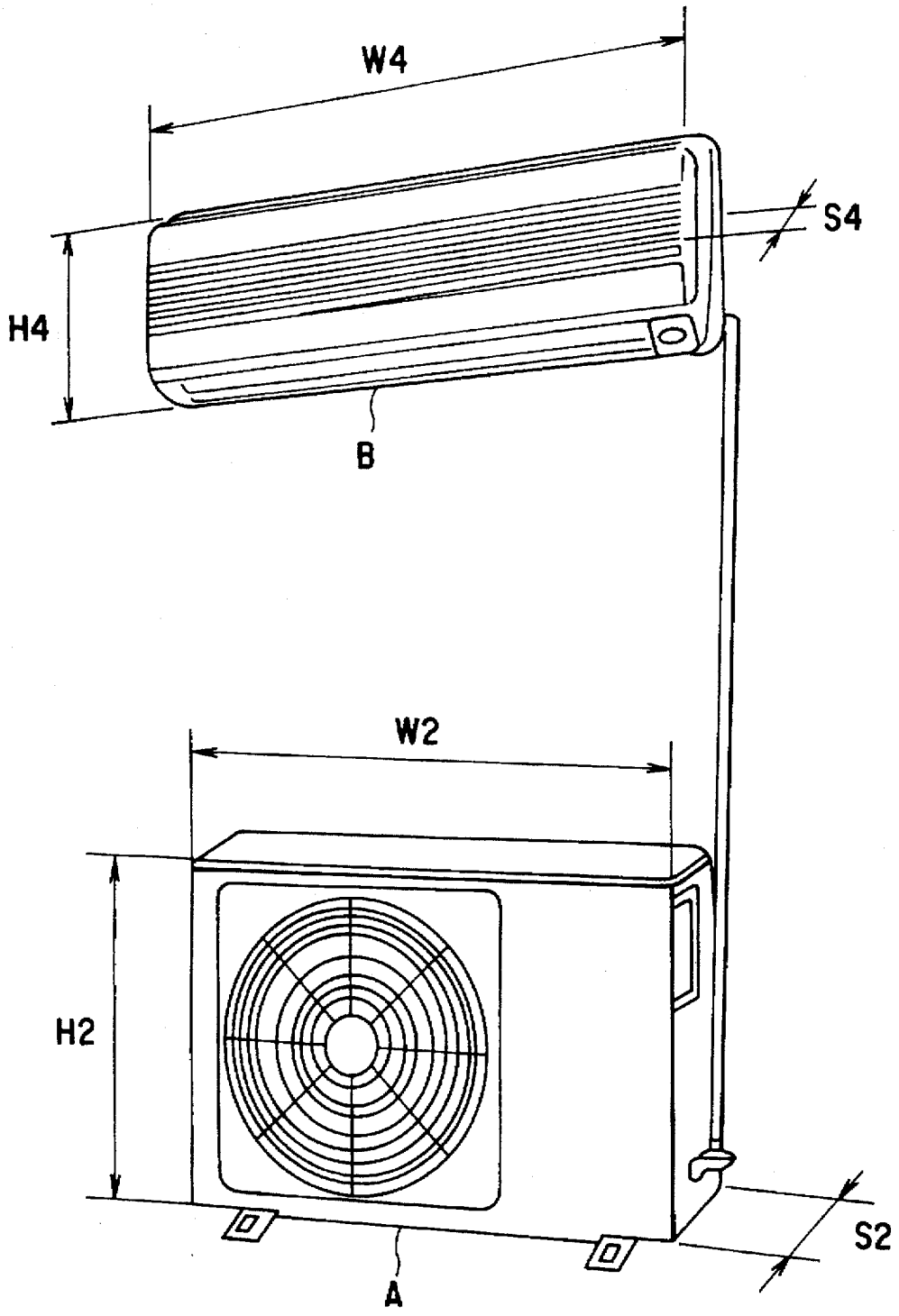
FIG. 14 PRIOR ART
FIG. 14 is a perspective view of a conventional air conditioner, indicating the dimensions of the indoor and outdoor units of the air conditioner.

FIG. 14 shows a conventional air conditioner comprising an indoor unit A and an outdoor unit B. The outdoor unit A, which contains a compressor, has a width W2, a height H2 and a depth S2. Obviously, the the width W2, height H2 and depth S2 are much greater than the width W1, height H1 and depth S1 of the outdoor unit 2 (FIG. 1) of the air conditioner according to the present invention. In short, the outdoor unit 2 is much smaller and lighter than the outdoor unit A of the conventional type. Thus it can be installed in a smaller space and held by a simpler support.

On the other hand, the indoor unit 1 of the air conditioner according to the invention has a height H3 and a width W3 which are almost the same as the height H4 and W4 of the indoor unit B of the conventional type. The depth S3 of the indoor unit 1 is greater than the depth S4 of the conventional indoor unit B, however. This is inevitably because the indoor unit 1 contains the compressor 8. Nonetheless, the depth S3 of the unit 1 is far less than the depth S2 of the conventional outdoor unit A. The indoor unit 1 does not project from the wall so much as to give a sense of oppressing the in the room.

As described above, of two spaces in the housing 1A, which are defined by the partition 15 and the side walls 16, the upper plate 5a and the lower plate **5*b*, the lower space which opens at the front of the housing 1A is used as the fan chamber 17, while the upper space which opens at the back of the housing 1A is used as the compressor chamber 18**. According to the present invention, however, there are provided indoor units of other structures.

Figure 5A:
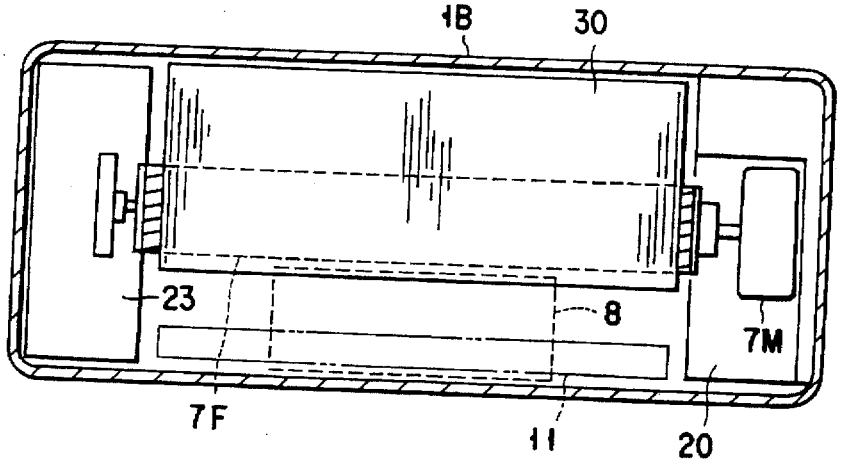
FIG. 5A is a sectional front view of the indoor unit used in an air conditioner according to a second embodiment of the invention.
Figure 5B:
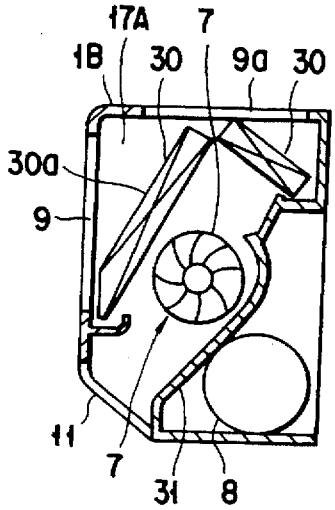
FIG. 5B is a sectional side view of the indoor unit shown in FIG. 5A.

FIGS. 5A and 5B are sectional front and side views of the indoor unit used in an air conditioner according to the second embodiment of the invention. The indoor unit is identical to the indoor unit 1 shown in FIGS. 2 to 4, except for some respects, as will be described below. The components similar or identical to those shown in FIGS. 2 to 4 are denoted at the same reference numerals in FIGS. 5A and 5B and will not be described in detail.

The indoor heat exchanger 30 incorporated in this indoor unit is comprised of a front unit 30*a* and a rear unit 30*b*. The front unit 30*a* extends slantwise from the top to front of the housing 1B of the indoor unit. The rear unit 30*b* extends slantwise from the top to back of the housing 1B. Thus, the units 30*a* and 30*b* are arranged in the form of an inverted letter V. The front of the housing 1B has a first air inlet port 9, which exposes the front unit 30*a* of the heat exchanger 30. The top of the housing 1B has a second air inlet port 9*a*, which exposes the rear unit 30*b* of the heat exchanger 30.

Since the indoor heat exchanger 30 is accommodated in the upper part of the housing 1B, a compressor 8 needs to be provided in another part of the housing 1B. A partition 31, which is not curved to have an S-shaped cross section, is provided in the housing 1B, extending from the upper-rear edge of the housing 1B to the lower-front part of the housing 1B. Thus, the partition 31 divides the space in the housing 1B into a fan chamber 17A which opens at the front of the housing 1B and a compressor chamber 18A which opens at the back of the housing 1B. A fan 7 is provided in the fan chamber 17A, and the compressor 8 in the compressor chamber 18A. The compressor 8 is located below the fan 7, whereas in the indoor unit 1 shown in FIGS. 2 and 3 the compressor 8 is positioned above the fan 7.

As is shown in FIG. 5A, the electric component chamber 20 and the refrigerating cycle chamber 23 are provided in the right and left end portions of the housing 1B, respectively, whereas in the indoor unit 1 shown in FIG. 2 the chambers 20 and 23 are located in the left and right end portions of the housing 1A. Notwithstanding this difference in the positions of the fan 7, compressor 8, and chambers 20 and 23, the indoor unit shown in FIGS. 5A and 5B achieves the same advantages as the indoor unit 1 of the air conditioner illustrated in FIGS. 1 to 4.

Figure 6:
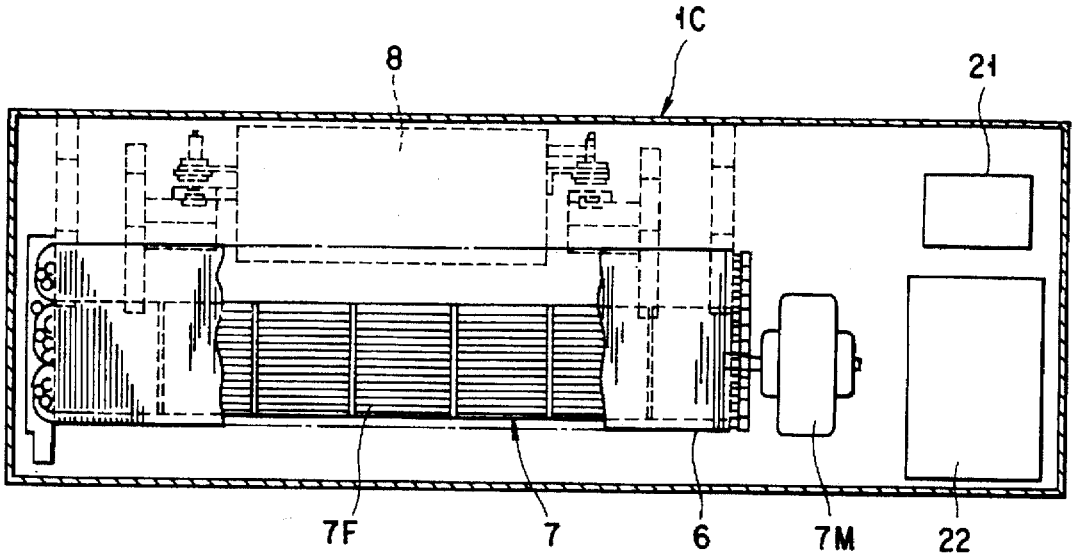
FIG. 6 is a sectional front view of the indoor unit used in an air conditioner according to a third embodiment of this invention.
Figure 7:
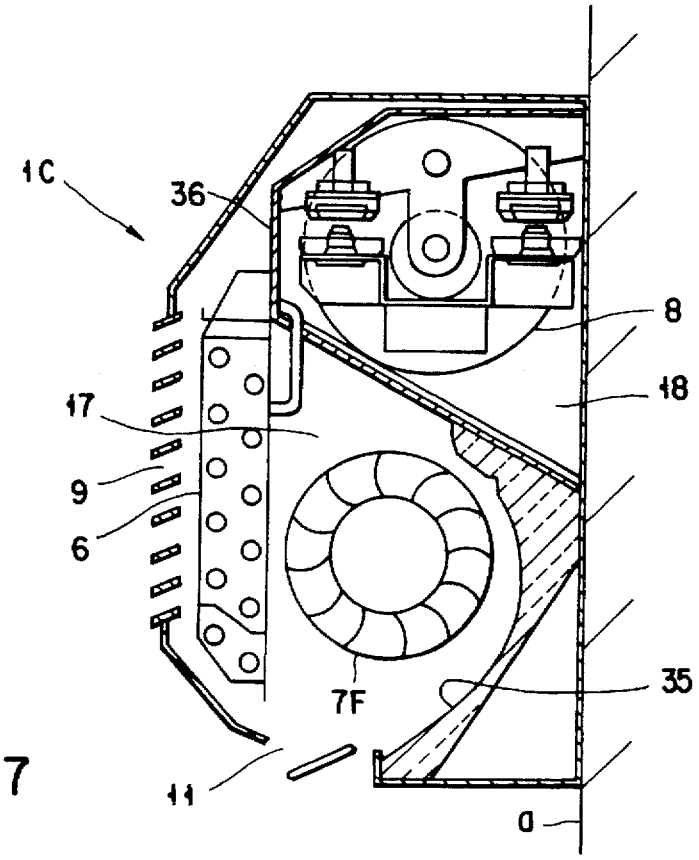
FIG. 7 is an enlarged sectional side view of the indoor unit illustrated in FIG. 6.

FIGS. 6 and 7 are sectional front and side views of the indoor unit used in an air conditioner according to the third embodiment of this invention. The indoor unit is identical to the indoor unit 1 shown in FIGS. 2 to 4, except for some respects, as will be described below. The components similar or identical to those shown in FIGS. 2 to 4 are denoted at the same reference numerals in FIGS. 6 and 7 and will not be described in detail.

As seen from FIGS. 6 and 7, the indoor unit incorporates an indoor heat exchanger 6, an indoor fan device 7 and a compressor 8. The heat exchanger 6, the fan 7 and the compressor 8 are located in the housing 1C at the same positions as in the indoor unit 1 illustrated in FIGS. 2 to 4. The motor 7M of the indoor fan 7 is provided in the right end portion of the housing 1C, not in the left end portion as in the indoor unit 1 shown in FIGS. 2 to 4. Nonetheless, the motor 7M performs exactly the same function as its counterpart does in the indoor unit 1.

The space in the housing 1C is divided into a fan chamber 17 and a compressor chamber 18 by an air-guiding plate 35 and a partition 36. The air-guiding plate 35 is made of heat-insulating material and provided at the back of the fan 7. The partition 36 is located above the fan 7 and overlaps in part the air-guiding plate 35. More precisely, the partition 36 consists of two parts. The first part extends slantwise from the upper end of the heat exchanger 6 to the air-guiding plate 35. The second part first extends upward from the upper end of the heat exchanger 6, then slantwise toward the top of the housing 1C, and extends horizontally, reaching the back of the housing 1C.

The air-guiding plate 35 and a part of the partition 36 define the fan chamber 17, which opens at the front of the housing 1C and in which the fan 7 is accommodated. The partition 36 defines the compressor chamber 18, which opens at the back the housing 1C and in which the compressor 8 is accommodated.

As is illustrated in FIG. 6, a driving circuit 21 and a control circuit 22 are provided in the right end portion of the housing 1c, not in the left end portion as in the indoor unit 1 shown in FIG. 2. Despite the difference in their positions, the driving circuit 21 and the control circuit 22 operates exactly in the same manner as their counterparts do in the indoor unit 1.

Since the compressor 8 is provided in the compressor chamber 18 defined by the partition 36, the noise the compressor 8 makes while operation scarcely leak from the housing 1C. Should the noise leaks from the housing 1C, it would not annoy the persons in the room so much because it propagates upwards from the housing 1C, which is secured to an upper part of the wall of the room.

Figure 8:
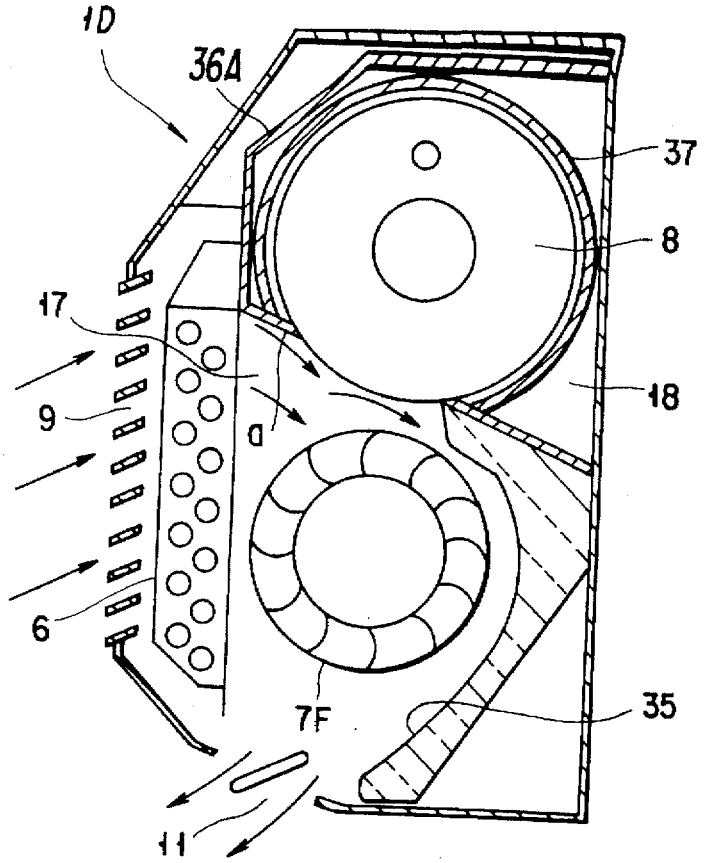
FIG. 8 is a sectional side view of the indoor unit incorporated in an air conditioner which is a fourth embodiment of the present invention.

FIG. 8 is a sectional side view of the indoor unit incorporated in an air conditioner which is the fourth embodiment of the present invention. This indoor unit is identical to the indoor unit 1 shown in FIGS. 2 to 4, except for some respects, as will be described below. The components similar or identical to those shown in FIGS. 2 to 4 are denoted at the same reference numerals in FIGS. 6 and 7 and will not be described in detail.

As in the indoor unit shown in FIGS. 6 and 7, the space in the housing 1D is divided into a fan chamber 17 and a compressor chamber 18 by an air-guiding plate 35 and a partition 36A. The air-guiding plate 35 is made of heat-insulating material and provided at the back of the fan 7. The partition 36A overlaps in part the upper end portion of the air-guiding plate 35. The partition 36A has a slanting portion which has an opening a. A compressor 8 has its lower part located in the opening a, thus projecting in part into the fan chamber 17. The remaining part of the compressor 8, which is located in the compressor chamber 18 is surrounded by a heat-insulating wall 37.

When the air conditioner according to the fourth embodiment is operated a in heating mode, the heat radiates from the lower portion of the compressor 8 into the fan chamber 17. The air heated by the heat exchanger 6 is thereby further heated. Thus, the heating efficiency of the air conditioner is high.

When the air conditioner is operated in cooling mode, it is necessary to prevent the heat from radiating into the fan chamber 17 from the compressor 8. The cooling efficiency would otherwise be reduced. Hence, the lower part of the compressor 8 is surrounded by a shutter (not shown) during the cooling operation, thus preventing heat from radiating into the fan chamber 17 from the compressor 8.

Figure 9:
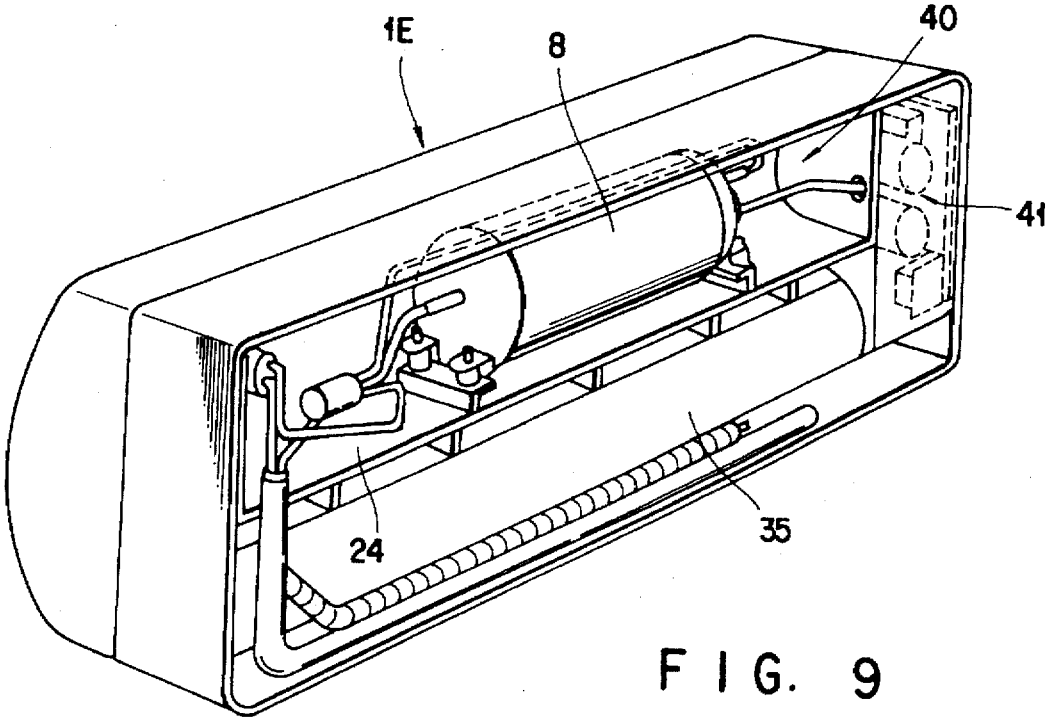
FIG. 9 is a perspective view of the indoor unit of an air conditioner which is a fifth embodiment of the present invention.

FIG. 9 is a perspective view of the indoor unit of an air conditioner which is the fifth embodiment of the present invention. The indoor Unit is characterized in that a first unit 40 and a second unit 41 are inserted into the housing 1E, from the back thereof. An air-guiding plate 35 is arranged below the first unit 40. As in the indoor unit shown in FIG. 8, a fan chamber is provided in front of the air-guiding plate 35, and a fan is accommodated in the fan chamber.

Figure 10A:
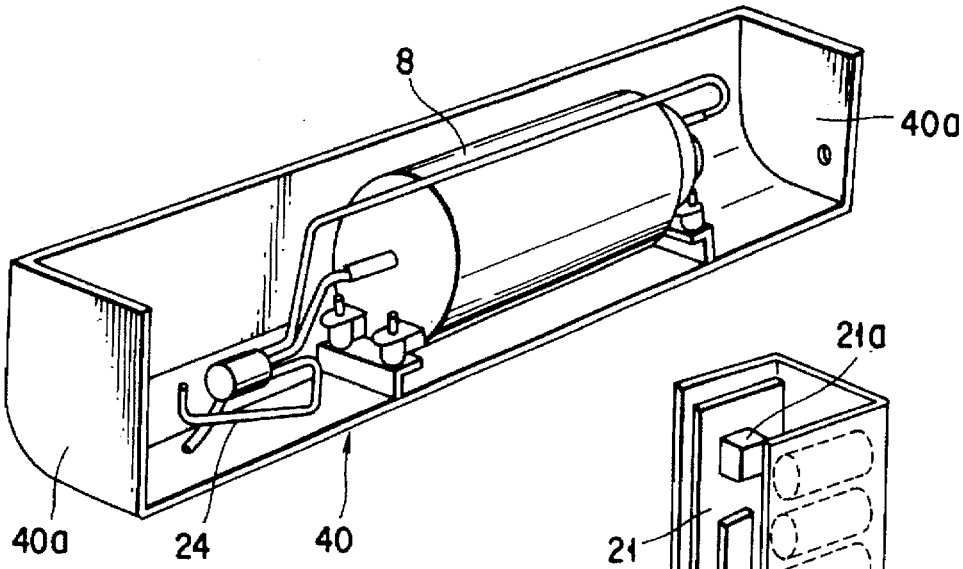
FIG. 10A is a perspective view of the compressor and the pipes incorporated in the indoor unit shown in FIG. 9.

As is seen from FIG. 10A, the first unit 40 comprises a trough-shaped housing, a compressor 8, and refrigerating-cycle components 24. The trough-shaped housing is formed of a bent plate, having an L-shaped cross section, and a pair of end plates 40*a* formed integral with the ends of the plate. The compressor 8 is secured to the bottom of the housing. The refrigerating-cycle components 24 are arranged at one end of the compressor 8. The first unit 40 is closed by a cover (not shown).

Figure 10B:
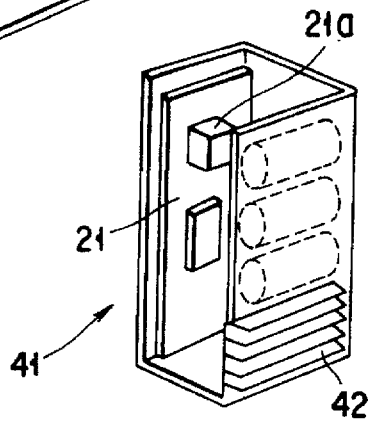
FIG. 10B is a perspective view of the driving circuit used in the indoor unit illustrated in FIG. 9.

As shown in FIG. 10B, the second unit 41 comprises a rectangular box, a driving circuit 21, and heat-radiating fins 42. The box opens at two adjacent sides. The driving circuit 21 is provided in the box and has electric and electronic components 21*a*. The fins 42 are provided on one side of the box, for radiating heat generated by the electronic components 21*a* such as giant transistors.

The first unit 40 and the second unit 41 are incorporated in the housing 1E, spaced apart from each other, as is illustrated in FIG. 9.

The noise the compressor 8 makes while operating does not leak into the room since the compressor 8 is sealed in a closed space defined by the trough-shaped housing and the cover (not shown). Dews, if formed on the refrigerating-cycle components 24, would not affect the electric and electronic components 21*a* to cause malfunction of the driving circuit 21 incorporated in the second unit 41. This is because the second unit 41 which contains the components 21a is spaced apart from the first unit 40 which incorporates the refrigerating-cycle components 24.

Figure 11:
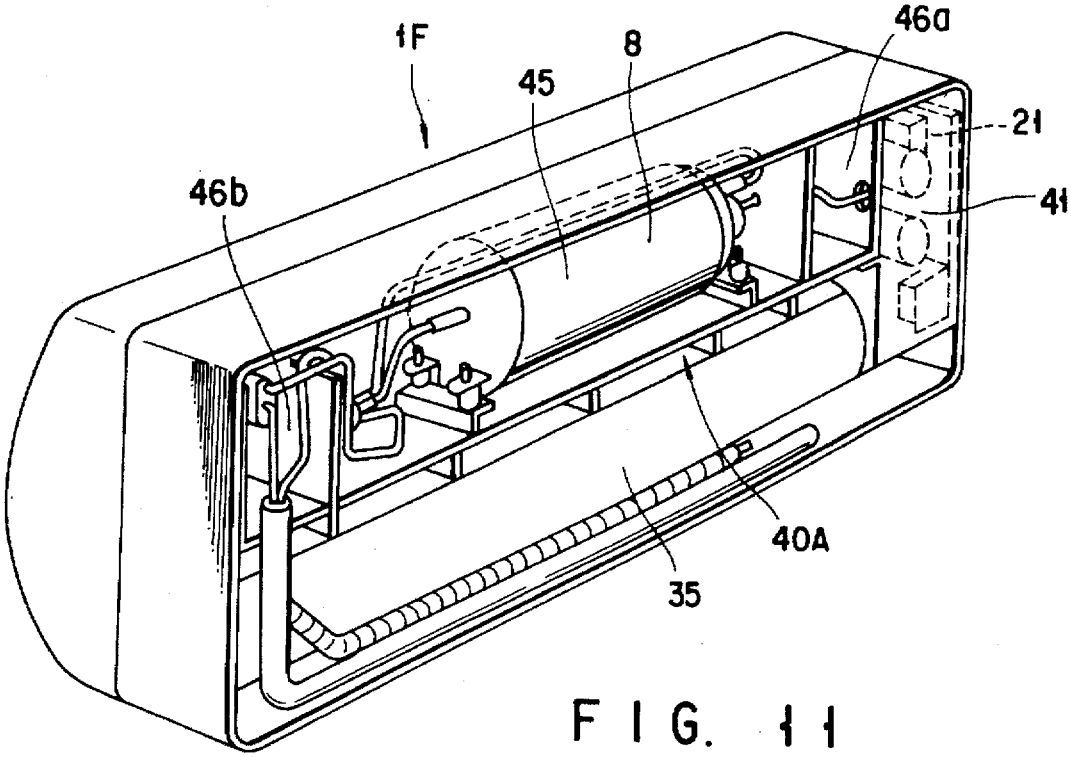
FIG. 11 is a perspective view of the indoor unit of an conditioner according a sixth embodiment of the present invention.

FIG. 11 shows the indoor unit of an conditioner according the sixth embodiment of this invention. The indoor unit comprises a housing 1F, a first unit 40A incorporated in the housing 1F, and a second unit 41 provided in the housing 1F. The second unit 41 is of the same type used in the fifth embodiment and contains a driving circuit 21. An air-guiding plate 35 is arranged below the first unit 40A. In front of the plate 35 there is provided a fan chamber, which contains an indoor fan.

Figure 12:
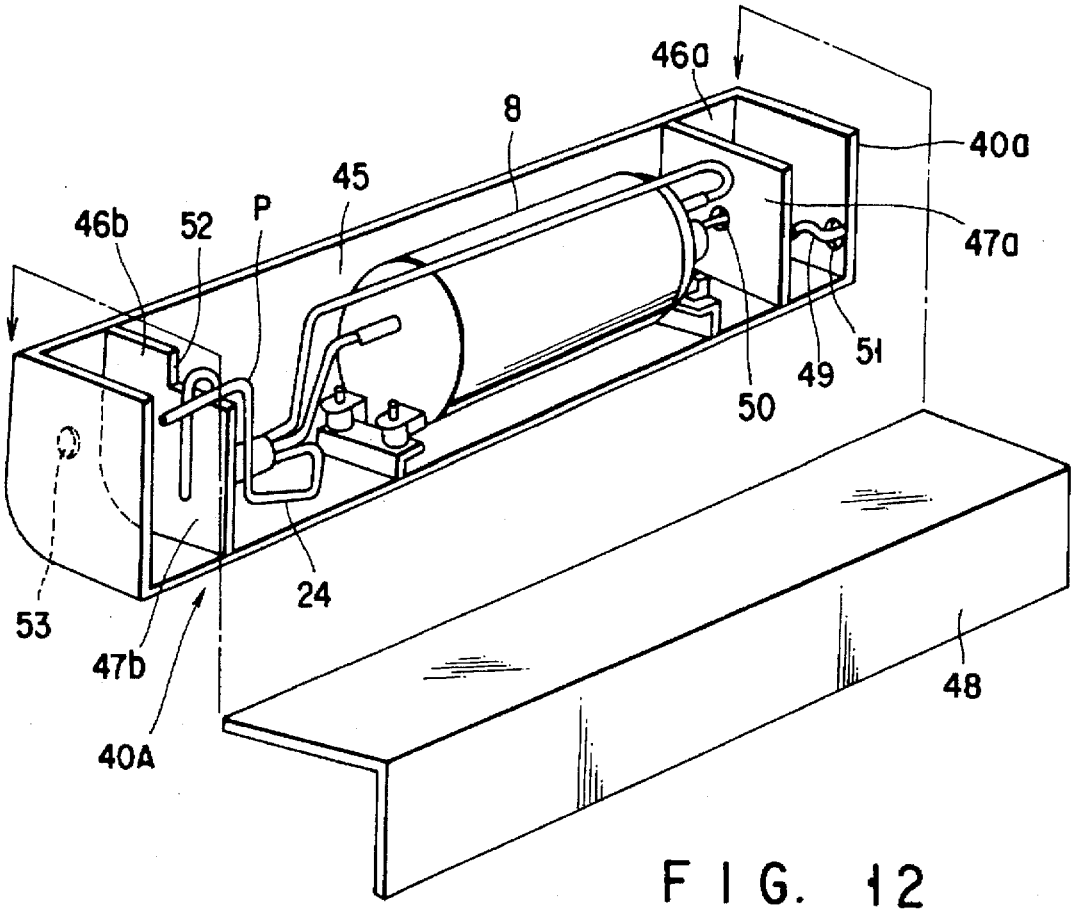
FIG. 12 is a perspective view showing the machinery chamber, the muffler chamber and the cover, all incorporated in the indoor unit shown in FIG. 11.

As shown in FIG. 12, a greater part of the first unit 40A is a machine chamber 45, in which a compressor 8 and pipes 24 are arranged. Two muffler chambers 46*a* and 46*b* are provided on the sides of the machine chamber 45, separated from the machine chamber 45 by two partitions 47*a* and 47*b*. The first unit 40A is closed by a cover 48 which is a plate bent and has an L-shaped cross section. The first unit 40A is therefore completely sealed.

As can be understood from FIG. 12, the housing of the first unit 40A is of the same structure as the first unit 40 shown in FIG. 10A, except that it has the partitions 47*a* and 47*b*. One end plate 40*a* of the housing and the first partition 47*a*, which define the first muffler chamber 46*a*, have a hole 50 and a hole 51, respectively. A cord 49 extends through these holes 50 and 51, electrically connecting the compressor 8 to the electric components of the driving circuit 21 incorporated in the second unit 41. The holes 50 and 51 are so positioned that their axes are not aligned.

Figure 13:
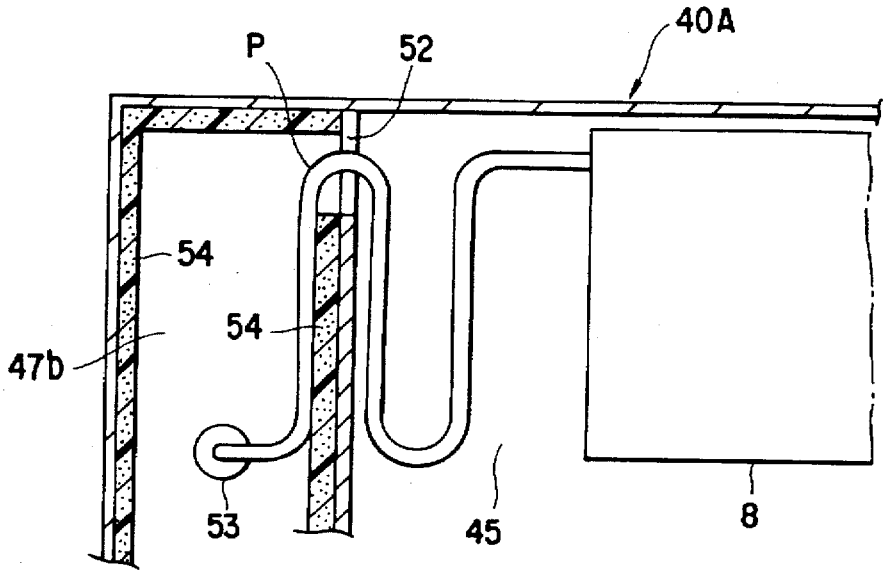
FIG. 13 is a partially sectional front view showing the machinery chamber and the muffler chamber.

The second partition 47*b* has a U-notch 52. The trough-shaped housing has a hole 53 which opens to the second muffle chamber 46*b*. The U-notch 52 and the hole 53 are so positioned that their axes are not aligned. As shown in FIG. 13, a refrigerant pipe p is connected to the compressor 8 placed in the machine chamber 45. The pipe p passes through the U-notch 52 into the second muffler chamber 46*b* and extends outwards from the first unit 40A through the hole 53 made in the trough-shaped housing.

As illustrated in FIG. 13, an noise-absorbing layer 54 is adhered to the entire inner surface of the second muffler chamber 46*b*. Though not shown, an noise-absorbing layer 54 is adhered to the entire inner surface of the first muffler chamber 46*a*.

The compressor 8 makes noise while operating. The sound waves emanating from the compressor 8 are widely dispersed in the machine chamber 45. Hence, the noise is reduced in the chamber 45 to some degree. The noise, though reduced, leaks into both muffler chambers 46*a* and 46*b* through the hole 50 and the U-notch 52.

The hole 50 made in the first partition 47*a* is so large that the cord 49 passes without contacting the partition 47*a*. Similarly, the U-notch 52 made in the second partition 47*b* is so large that the refrigerant pipe p passes without contacting the partition 47*b*. Therefore, the cord 49 does not transmit vibration of the compressor 8 to the partition 47*a*. Nor does the pipe p transmit the vibration to the partition 47*b*. The first unit 40A is less vibrated than otherwise, while the compressor 8 is operating.

The greater part of the noise which has leaked into the muffler chambers 46*a* and 46*b* through the hole 50 and the U-notch 52 is absorbed by the noise-absorbing layers 54 adhered to the inner surface of the muffler chambers 46*a* and 46*b*. The remaining part of the noise scarcely leaks from the first muffler chamber 46*a* or from the second muffler chamber 46*b*. This is because the hole 50 and the U-notch 52 are not axially aligned with the holes 51 and 52, respectively, and the sound waves passing through the hole 50 and the U-notch 52 are not guided to the holes 51 and 52, respectively.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An indoor unit for an air conditioner, comprising:

a main body having an inner space partitioned by a partition wall into an upper space and a lower space, said partition wall extending from an upper region to a lower region of said main body and having a generally S-shaped cross section;

a compressor chamber formed in said upper space within the main body and having an opening at a back portion of the main body;

a fan chamber formed in said lower space within the main body and having an opening at a front portion of the main body;

a compressor arranged within said compressor chamber such that the axis of said compressor extends in a generally horizontal direction;

fan structure arranged within said fan chamber and including a fan motor and an elongated cross-flow fan connected to a shaft of said fan motor such that the axis of said cross-flow fan extends in a generally horizontal direction and generally parallel to the axis of the compressor; and a heat exchanger interposed between the fan and the front opening of said fan chamber.

2. The indoor unit according to claim 1, wherein said partition wall has reinforcing ribs which protrude into said fan chamber and which function as air-regulating fins as well.

3. The indoor unit according to claim 1, wherein said main body has an electric component chamber on one side of said partition means and a refrigerating-cycle component chamber on another side of said partition means, said electric component chamber containing electric components, and said refrigerating-cycle component chamber containing refrigerating-cycle components such as pipes and valves.

4. The indoor unit according to claim 1, wherein said main body is designed to be secured to an upper part of a wall of a room.

5. The indoor unit according to claim 1, further comprising a driving circuit incorporated in said fan chamber to electrically drive said compressor, and a control circuit provided in said fan chamber to optimally control the driving circuit.

6. The indoor unit according to claim 1, wherein said compressor and pipes connected to said compressor are provided in the form of a compressor unit, a driving circuit is provided in the form of a circuit unit for electrically driving said compressor, said compressor unit and said circuit unit being spaced apart from each other.

7. The indoor unit according to claim 6, wherein said driving circuit has electric and electronic components, and said circuit unit has heat-radiating fins which protrude into said fan chamber to radiate heat from those of electric and electronic components which generate much heat while operating.

8. The indoor unit according to claim 6, wherein said compressor unit comprises a machine chamber which contains said compressor and said pipes, and muffler chambers which are provided adjacent to said machine chamber and through which said pipes extend.

9. The indoor unit according to claim 8, wherein said pipes extending through said muffler chambers further extend from said muffler chambers and from said compressor unit, passing through openings which are made in partition plates defining said machine chamber and said muffler chambers and which are out of axial alignment.

10. The indoor unit according to claim 8, wherein said pipes extending through said muffler chambers further extend from said muffler chambers and from said compressor unit, passing through openings which are made in side walls defining said machine chamber and said muffler chambers and which are large enough to allow said pipes to pass without contacting said partitioning plates.

11. An indoor unit for an air conditioner, comprising: a main body;

a heat exchanger mounted in said main body;

partition means for partitioning an inner space of said main body into an upper space and a lower space;

a fan chamber formed in said upper space within the main body and having an opening at the front of the main body;

a fan mounted in said fan chamber, a compressor chamber formed in said lower space within the main body and having an opening at a back of the main body; and a compressor mounted in said compressor chamber, wherein said partition means consists of a partition wall having reinforcing ribs mounted in a region facing both said fan chamber and compressor chamber and on a side of the compressor, said reinforcing ribs being constructed and arranged to function as air-regulating fins.

* * * * *